US006648251B1

(12) United States Patent
Chollet

(10) Patent No.: US 6,648,251 B1
(45) Date of Patent: Nov. 18, 2003

(54) DEVICE AND METHOD FOR DISAGGREGATING DERIVED TIMBER PRODUCTS

(75) Inventor: Patrick Chollet, Le Havre Cedex (FR)

(73) Assignee: Pfleiderer AG, Neumarkt (DE)

( * ) Notice: Subject to any disclaimer, the term of this patent is extended or adjusted under 35 U.S.C. 154(b) by 0 days.

(21) Appl. No.: 09/959,393

(22) PCT Filed: Jun. 17, 2000

(86) PCT No.: PCT/EP00/05612

§ 371 (c)(1),
(2), (4) Date: Jan. 7, 2002

(87) PCT Pub. No.: WO01/21368

PCT Pub. Date: Mar. 29, 2001

(30) Foreign Application Priority Data

Sep. 22, 1999 (DE) ..... 199 45 463

(51) Int. Cl.[7] ..... B02C 19/12; B02C 19/22

(52) U.S. Cl. ..... 241/19; 241/23; 241/29; 241/66; 241/152.1; 241/260.1

(58) Field of Search ..... 162/189; 241/23, 241/29, 260.1, 65, 66, 67, 152.1, 19, 28

(56) References Cited

U.S. PATENT DOCUMENTS 3,741,863 A * 6/1973 Brooks ..... 162/4
4,915,308 A * 4/1990 Koenig ..... 241/161
6,505,550 B2 * 1/2003 Hamilton ..... 100/148

* cited by examiner

*Primary Examiner*—Mark Rosenbaum
(74) *Attorney, Agent, or Firm*—Antonelli, Terry, Stout & Kraus, LLP

(57) ABSTRACT

The invention relates to a device for disaggregating pieces of derived timber products from cellulose and/or lignocellulose-containing products, especially particle boards, medium-density fiber boards and the like, with a transport device and at least one disaggregation container. The inventive device is also characterized in that the disaggregation container and the transport device are configured as at least one common densifier screw (1) with a housing-mounted outer shell and a driven shaft located therein. The shaft is provided with helices of a predefined pitch. The pieces of derived timber products are transported in the axial direction of the densifier screw (1) from a feed opening in the outer shell towards an outlet opening on the front side thereof in the axial direction (direction of transport). A feed opening (7) for vapor is provided in the outer shell between the inlet opening and the outlet opening.

15 Claims, 1 Drawing Sheet

DEVICE AND METHOD FOR DISAGGREGATING DERIVED TIMBER PRODUCTS

BACKGROUND OF THE INVENTION

The present invention relates to a device for disaggregating derived timber products according to the preamble of the main claim and to a method for implementing the same.

A device of this type has been disclosed (DE 198 19 988). In this device, a screw feeder functions as the transport device for conveying the disaggregation material through the impregnation and pre-swell shaft, while the function of the second screw feeder is to discharge the already disaggregated material from the disaggregation shaft. In the disaggregation shaft itself, the disaggregation material is not conveyed by screw feeders. The disadvantage of this device is the fact that, during disaggregation under pressure, appropriate measures must be taken to make the filling shaft pressure-sealable.

DISCLOSURE OF THE INVENTION

The object he present invention is thus to create a device and a method which permit continuous, and therefore simple and economical disaggregation of derived timber products.

This object is achieved by a device for disaggregating pieces of derived timber products made from cellulose-containing and/or lignocellulose-containing materials, specifically particle board, medium-density fiberboard and the like, with a transport device and at least one disaggregation vessel, characterized in that the disaggregation vessel and the transport device are designed as at least one combined-function plug screw feeder with an outer casing attached to the housing and a drivable shaft located therein provided with helices of a predefined pitch, the pieces of derived timber products being conveyed in the plug screw feeder from a feed opening in the outer casing to an end-face discharge opening in the axial direction (direction of conveyance), and characterized in that a delivery opening for steam is provided in the outer casing between the feed opening and the discharge opening.

The object is also achieved by a process for disaggregating pieces of derived timber products made from cellulose-containing and/or lignocellulose-containing materials, specifically particle board, medium-density fiberboard and other residual materials and waste produced from lignocellulose-containing materials, using a conveyance device as well as a disaggregation vessel, characterized in that the derived timber products are conveyed continuously through pressure-sealed, sequentially arranged plug screw feeders, thereby undergoing the action of shearing and frictional forces occurring in the plug screw feeder, and in that steam is forced into at least one of the plug screw feeders which is neither the first nor the last plug screw feeder.

The surprising determination was made that an arrangement of preferably at least three plug screw feeders in tandem permits the passage of the disaggregation material such that the feedstock is able to seal the plug screw feeders to the degree necessary for performing the disaggregation process under pressure. Here the steam is introduced, preferably at a pressure of 2 bars, into one of the plug screw feeders which is neither the first nor the last one in the sequence of plug screw feeders. Arrangements of, for example, five or more plug screw feeders are preferred, the steam being introduced into the middle section of the sequentially arranged plug screw feeders, for example, into the third in a sequence of five plug screw feeders. While in the side plug screw feeder[s] here, a pressure drop reaching atmospheric pressure may be observed, the arrangement results in the working pressure being sustained in the middle section, said pressure being up to 11 bars but at least 2 to 3 bars of overpressure.

A fundamental advantage of a method thus implemented on a completely continuous basis according to the invention lies specifically in the fact that complex and expensive measures to seal the system may be dispensed with and that continuous processing is nevertheless possible. Processing is thus possible without the opening and subsequent sealing of system components, and as a result there is no concomitant loss of energy or discharge of pollutants from the system. Thus from both the standpoint of economy and ecology, the device may thus operated at an optimal level.

In the method according to the invention, specifically when at least five plug screw feeders are used, disaggregation pressures of 2 bars to 11 bars of overpressure may be sustained, the range of operation being preferably between 3 bars and 8 bars, and especially between 2 bars and 6 bars. When steam is introduced at an overpressure of 4 bars, the disaggregation temperature at the steam inlet is approximately 143° C.

Since passage through the screw feeder entails not only the conveyance of the disaggregation material but also its homogenization, the friction of the particles against each other results in a continuous comminution mechanically and facilitates chemical hydrolysis. The result is that the disaggregation of the particles is accelerated such that a residence time of only a few minutes is sufficient to produce a high level of disaggregation. In the event the derived timber products are more hydrolysis-resistant, appropriate means may be employed to accelerate hydrolysis such as raising or lowering the pH.

The disaggregation process from the addition of the comminuted particleboard fragments through the completely disaggregated, moist wood pulp is thus effected by multiple, at least three, sequentially arranged screw feeders. These pressure-sealed plug screw feeders perform multiple functions: conveyance as well as continuous comminution and hydrolysis of the pre-swollen wood pulp, initially by the friction of the particles against each other, and the actual disaggregation process under the action of water, steam and absorption of heat within the tubular screw feeder system. Use of a modular design is possible here in which multiple identical screw feeders and drive systems are employed, which use significantly reduces cost.

The independently controllable plug screw feeders and drive systems allow the feed rate to be adapted to existing process conditions, the maximum limits being set only by the dimensioning of the conveyance systems and the reaction speed of disaggregation.

Since the entire process proceeds under pressure, the entire system must be pressure-sealed, a feature which has the advantage of preventing any harmful emissions emanating from the disaggregation process from entering the environment.

Since the system is operated without generating effluents, environmental considerations have been accorded a high priority.

It has proven useful to fill the first plug screw feeder into which the disaggregation material has been introduced with preheated water. The water temperature here can range between approximately 20° C. and 95° C.

Conveyance by the screw feeder within the system allows for homogenization of the wood pulp, and the constant friction caused by the conveyance creates desirable and continuous comminution, thereby facilitating wetting of the surface. The result is that the enthalpy of the steam may be utilized over the entire length of the tube since the friction continuously separates the solubilized layers mechanically and exposes the underlying, not-yet-separated layers which are then readily acted upon by the steam. The process may be further accelerated by using higher process pressures.

Waste gas heat can be almost completely utilized and is thus not lost as is the case with the discontinuous process of the prior art. The heat provided by the moist disaggregated wood pulp is also utilized by the fact that the conveyance path from the point after the material has exited the last screw feeder to the drier is extremely short. This feature minimizes heat loss and drying cost.

The absorption of water, steam and heat by the disaggregation material may be very precisely adjusted by controlling the rate of feed—a feature which facilitates additional optimization of the process parameters, especially energy consumption, and optimal process control.

The plug screw feeders may be arranged sequentially in any desirable configuration. To save space, the preferred arrangement is one in which the outlet of each plug screw feeder discharges at right angles into the inlet section of the following plug screw feeder.

As the material is conveyed plug screw feeders are employed, according to the invention, which create a pressure in the conveyed material. These screw feeders, which are also designated plug screw feeders, are, for example, unilaterally bearing-mounted screw feeders, the outlet opening of which runs in the axial direction. They may have a progressive or degressive pitch, that is, spacing per turn between helices may be made larger or smaller.

The temperature of disaggregation has a significant effect on the hydrolysis of the derived timber products. The higher the pressure of the steam utilized for disaggregation, the higher is the disaggregation temperature. At a steam pressure of 4 bars overpressure, the temperature is approximately 143° C. Disaggregation temperatures in the range of 8 bars may, depending on the type of wood and other process parameters, result in undesirable discoloration of the chips. Steam pressures must therefore be carefully monitored. Generally, pressures between 7 bars and 11 bars are selected, but preferably those between 2 bars and 8 bars, and especially in the range of between 3 bars and 6 bars of overpressure.

The rate of conveyance through the plug screw feeders varies as a function of the number of screw feeders employed. Given a greater number of screw feeders, the rate of throughput may be increased, whereas for a smaller number this rate must be reduced in order to ensure the required residence time for disaggregation. Depending on the pressure, complete disaggregation may be generally achieved after a residence time of around approximately 30 minutes, and preferably 20 minutes, such that the use of more than three screw feeders entails a residence time per plug screw feeder of only a few minutes. Compared to traditional discontinuous disaggregation processes, this amounts to a considerable reduction in disaggregation time.

Under the above conditions, the plug screw feeders generally attain rotational speeds in the range of a few rotations per minute, for example, 3 rpm to 10 rpm.

When the material is introduced into the first plug screw feeder, it has proven to be advantageous to add preheated water. Water temperatures may range between 200° C. and 95° C. Acting together with the charged wood materials, the water creates an additional seal against the external atmospheric pressure for the overpressure utilized for disaggregation.

The wood material to be disaggregated is precomminuted at a coarse level before disaggregation, particle sizes in the range of approximately 3 cm to 10 cm, preferably 3 cm to 5 cm, having proven to be especially suitable. Comminution to less than 2 cm brings no advantage since the removal of coatings or other impurities then becomes more difficult.

Experience has shown that, under favorable conditions, for example, with proper sealing of the individual plug screw feeders, only three screw feeders arranged sequentially are sufficient to sustain the appropriate disaggregation pressure matching the pressure of the introduced steam in the middle screw feeder. In an arrangement of more than three plug screw feeders, the zone of desirable reaction pressure is extended, with the result that the throughput rate for the individual plug screw feeders may be increased.

The first plug screw feeder is advantageously equipped on the material-charging side with a high-pressure lock. Pressure control is not necessarily required at the outlet side since the pressure here is allowed to fall to ambient pressure.

BRIEF DESCRIPTION OF THE DRAWINGS

The following discussion explains the invention in more detail based on the following description referencing the drawing and examples. In the drawing.

DETAILED DESCRIPTION OF THE INVENTION

EXAMPLE 1

Figure 1:
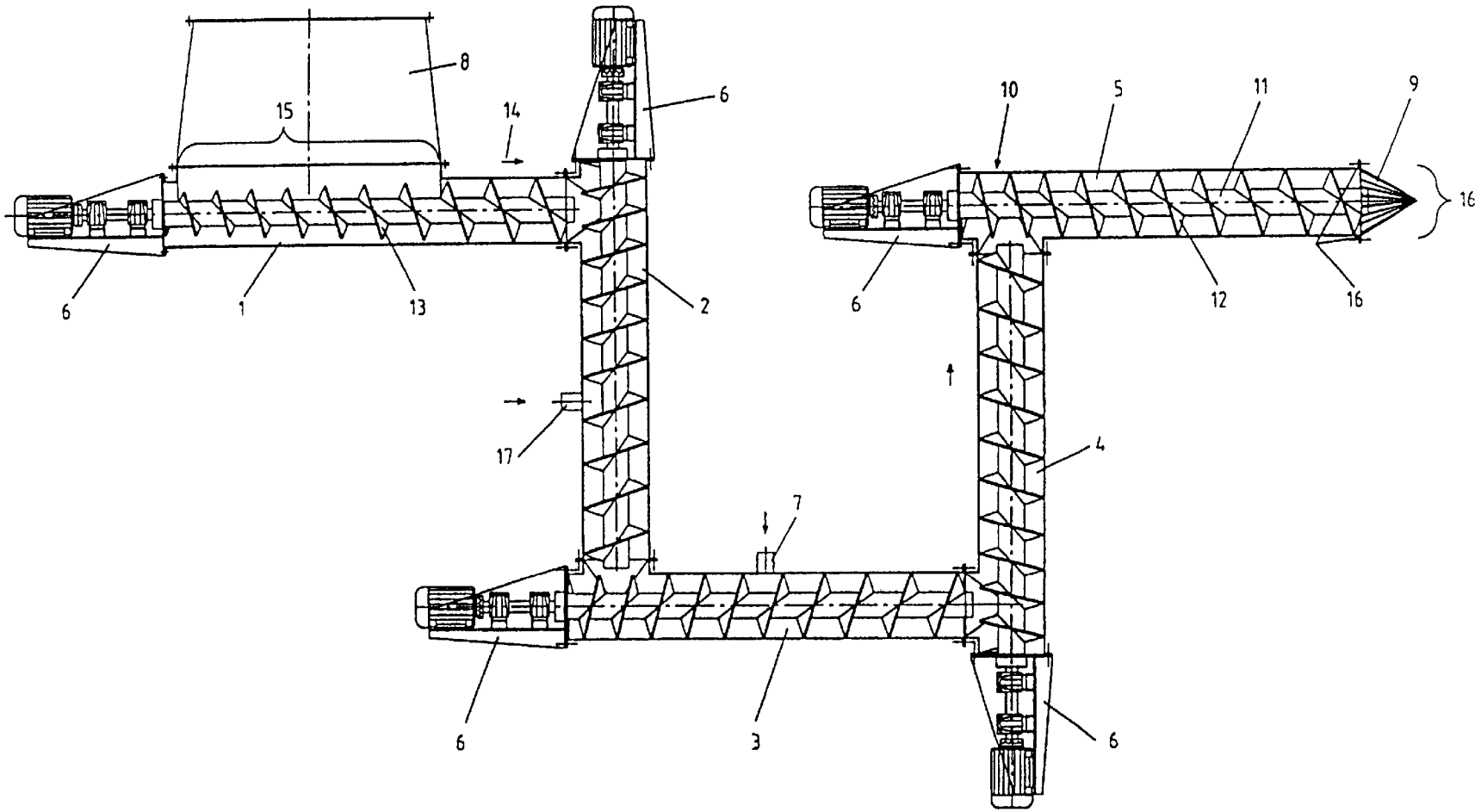
FIG. 1 shows the design of a device according to the invention with a total of five plug screw feeders to implement the method according to the invention.

Five plug screw feeders were arranged sequentially such that the axial outlet of each plug screw feeder discharged laterally approximately at right angles into the inlet section of the following plug screw feeder. All connections between plug screw feeders were designed to be pressure-sealed.

The plug screw feeders were of uniform dimensions, with a diameter of 400 mm and a length of 2.5 m. Power was provided by electric motors, each rated at 10 kW. The first plug screw feeder was provided with a high-pressure lock containing a level indicator.

A steam feed line was located in the center of the third plug screw feeder, which line was connected to a steam source for saturated steam at 5 bars abs. The last plug screw feeder was equipped with a vapor extraction device at the end of the screw feeder.

Fiberboard material was fed into the first plug screw feeder, which material had been comminuted to a particle size of 8×8×20 $cm^3$. The screw feeder was filled with preheated water at a temperature of approximately 90° C.

The feed rate of the plug screw feeders was adjusted to yield a residence time of about 5 minutes in each plug screw feeder. Saturated steam at a pressure of 4 bars was fed into the steam line of the third plug screw feeder.

The chips accumulating at the outlet of the last plug screw feeder essentially resembled the usual fresh chips, both visually and in terms of particle size.

The device shown in FIG. 1 contains five sequentially arranged plug screw feeders 1, 2, 3, 4 and 5 which are driven by drive motors 6. The axial outlet section of each screw feeder is flanged axially at right angles onto the inlet section of the following plug screw feeder using pressure-sealed connections. Plug screw feeder 3 contains a steam feed 7 which is connected to a saturated steam source (not shown). Plug screw feeder 1 contains a charging device 8 to feed the disaggregation material. Located at the end of the last screw feeder 5 is either a vapor extraction device or a spring aperture 9.

The device shown in FIG. 1 has a total of five pressure screw feeders, also designated plug screw feeders 1, 2, 3, 4, 5, each driven by drive motors 6. The preferably precrushed pieces of derived timber products are fed as the feed material to the first screw feeder. On last screw feeder 5, there is provided an end-face discharge opening with a spring aperture. The five plug screw feeders are arranged sequentially and function simultaneously as disaggregation vessels and transport devices for the pieces of derived timber products. Each plug screw feeder has an outer casing 10 attached to the housing and a drivable shaft 11 located therein with surrounding helices 12 of a predefined pitch. The particles are conveyed between the turns of the helices, on the one hand, and between the (inner) shaft and the (external) outer casing. In the embodiment shown, plug screw feeders 2, 3, 4, 5 each have pitches which are identical but which could also be different.

In contrast, plug screw feeder 1 has helices 13 with a diameter or pitch which changes.

The pressure screw feeder and plug screw feeder 3 are each arranged horizontally. Plug screw feeders 2 and 4, on the other hand, are arranged perpendicular to these, preferably at right angles.

The individual screw feeders are connected sequentially such that the pieces of derived timber products are conveyed in the axial direction (direction of conveyance) 14 of the plug screw feeder from the feed opening 15 in outer casing 10 to an end-face discharge opening 16 in the axial direction (direction of conveyance 14), the delivery opening 7 for steam being provided in plug screw feeder 3 between the feed opening and the discharge opening in outer casing 10. Plug screw feeder 2 may be provided with an inlet opening 17 for water, preferably hot water. All the plug screw feeders, or at least some of these, may be of a heatable design.

What is claimed is:

1. Device for disaggregating pieces of derived timber products made from cellulose-containing and/or lignocellulose-containing materials, comprising a transport device and at least one disaggregation vessel, characterized in that the disaggregation vessel and the transport device are designed as at least three combined-function plug screw feeders arranged sequentially such that the discharge opening of the foremost plug screw feeder is connected in a pressure-sealed manner to the feed opening of the following plug screw feeder arranged in the direction of conveyance, the plug screw feeders having an outer casing and a drivable shaft located therein provided with helices of a predefined pitch, the pieces of derived timber products being conveyed in the plug screw feeders from a feed opening in the outer casing of a first of the plug screw feeders to an end-face discharge opening in the last of the plug screw feeders in the direction of conveyance, and characterized in that a delivery opening for steam is provided in the outer casing between the first plug screw feeder and the last plug screw feeder in the direction of conveyance.

2. Device according to claim 1, characterized in that the delivery opening is designed as a pressurized steam opening.

3. Device according to claim 1, characterized in that the discharge opening of the last plug screw feeder in the direction of conveyance is provided with a vapor extraction device or a spring aperture.

4. Device according to claim 1, characterized in that a total of five sequentially arranged plug screw feeders are provided.

5. Device according to claim 1, characterized in that adjacent plug screw feeders are arranged at angles to each other in their axial direction.

6. Device according to claim 5, characterized in that adjacent plug screw feeders are arranged perpendicular to each other.

7. Device according to claim 5, wherein the first and last plug screw conveyors do not have a delivery opening for steam.

8. Device according to claim 1, characterized in that, with reference to the direction of conveyance, some of the plug screw feeders may be arranged horizontally and some, vertically.

9. Device according to claim 1, characterized in that at least one of the plug screw feeders is designed to be heatable and/or that the pitch of the helices in at least one of the plug screw feeders is not constant but increases or decreases in the direction of conveyance.

10. Process for disaggregating pieces of derived timber products made from cellulose-containing and/or lignocellulose-containing materials, using a conveyance device as well as a disaggregation vessel, comprising conveying the derived timber products continuously through pressure-sealed, sequentially arranged plug screw feeders, thereby undergoing the action of shearing and frictional forces occurring in the plug screw feeder, and forcing steam into at least one of the plug screw feeders which is neither the first nor the last plug screw feeder at an overpressure of at least 2 bars.

11. Process according to claim 10, characterized in that, in an arrangement of an uneven number of plug screw feeders, the steam is forced into the centermost plug screw feeder.

12. Process according to claim 10, characterized in that, in an arrangement of an even number of plug screw feeders, the steam is forced into one of the centermost plug screw feeders.

13. Process according to claim 10, characterized in that the steam has an overpressure of between 2 bars and 11 bars.

14. Process according to claim 10, characterized in that, before disaggregation, the derived timber products are comminuted to a particle size of at least 5×5 cm.

15. Process according to claim 10, characterized in that the plug screw feeders are additionally heated.

* * * * *

UNITED STATES PATENT AND TRADEMARK OFFICE

CERTIFICATE OF CORRECTION

PATENT NO. : 6,648,251 B1
DATED : November 18, 2003
INVENTOR(S) : Reiner Stracke It is certified that error appears in the above-identified patent and that said Letters Patent is hereby corrected as shown below:

Title page,
Item [75], Inventor, "Patrick Chollet, Le Havre Cedex (FR)" should read
-- Reiner Stracke, Rheda-Wiedenbruck, Germany --

Signed and Sealed this

Seventeenth Day of August, 2004

JON W. DUDAS
*Acting Director of the United States Patent and Trademark Office*

UNITED STATES PATENT AND TRADEMARK OFFICE

CERTIFICATE OF CORRECTION

PATENT NO. : 6,648,251 B1
DATED : November 18, 2003
INVENTOR(S) : Reiner Stracke It is certified that error appears in the above-identified patent and that said Letters Patent is hereby corrected as shown below:

Title page,
Item [75], Inventor, "Patrick Chollet, Le Havre Cedex (FR)" should read
-- Reiner Stracke, Rheda-Wiedenbruck, Germany
Rudolph Wilholt, Rheda-Wiedenbruck, Germany
Allreza Kharazipour, Gottingen, Germany
Kurt Nonninger, Ense, Germany --

This certificate supersedes Certificate of Correction issued August 17, 2004.

Signed and Sealed this

Twenty-eighth Day of December, 2004

JON W. DUDAS
*Director of the United States Patent and Trademark Office*

UNITED STATES PATENT AND TRADEMARK OFFICE

CERTIFICATE OF CORRECTION

PATENT NO. : 6,648,251 B1
DATED : November 18, 2003
INVENTOR(S) : Reiner Stracke It is certified that error appears in the above-identified patent and that said Letters Patent is hereby corrected as shown below:

Title page,
Item [75], Inventor, "Patrick Chollet, Le Havre Cedex (FR)" should read
-- Reiner Stracke, Rheda-Wiedenbruck, Germany
Rudolf Wilholt, Rheda-Wiedenbruck, Germany
Alireza Kharazipour, Gottingen, Germany
Kurt Nonninger, Ense, Germany --

This certificate supersedes Certificate of Correction issued August 17, 2004 and December 28, 2004.

Signed and Sealed this

Third Day of January, 2006

JON W. DUDAS
*Director of the United States Patent and Trademark Office*